US012735983B2

(12) United States Patent
Moore et al.

(10) Patent No.: US 12,735,983 B2
(45) Date of Patent: Sep. 15, 2026

(54) FLOWBACK MONITORING SYSTEM AND METHODS

(71) Applicant: Ideal Completion Services LLC, Tulsa, OK (US)

(72) Inventors: Cody Steven Moore, Evanston, WY (US); Hunter Parker, Kersey, CO (US); Austin Wollert, Kersey, CO (US)

(73) Assignee: Ideal Completion Services LLC, Tulsa, OK (US)

( * ) Notice: Subject to any disclaimer, the term of this patent is extended or adjusted under 35 U.S.C. 154(b) by 980 days.

(21) Appl. No.: 18/054,438

(22) Filed: Nov. 10, 2022

(65) Prior Publication Data

US 2023/0151732 A1 May 18, 2023

Related U.S. Application Data

(60) Provisional application No. 63/264,017, filed on Nov. 12, 2021.

(51) Int. Cl.
*E21B 49/08* (2006.01)

(52) U.S. Cl.
CPC ..... *E21B 49/087* (2013.01)

(58) Field of Classification Search
None
See application file for complete search history.

(56) References Cited

U.S. PATENT DOCUMENTS

| | | | | |
|---|---|---|---|---|
| 7,415,357 | B1 * | 8/2008 | Stluka | E21B 47/10 702/6 |
| 2007/0295501 | A1 * | 12/2007 | Poulisse | G01F 15/08 166/250.01 |
| 2010/0217575 | A1 * | 8/2010 | Briers | E21B 43/14 703/10 |
| 2016/0333686 | A1 * | 11/2016 | Scott | E21B 49/08 |

* cited by examiner

*Primary Examiner* — Giovanna Wright
(74) *Attorney, Agent, or Firm* — AVEK IP, LLC

(57) ABSTRACT

Systems and methods for well flowback monitoring include connecting wells to a test separator and a commingle separator; solitarily coupling a first well to the test separator; measuring output values of the first well via the test separator; coupling the first well to the commingle separator; solitarily coupling a second well to the test separator; measuring output values of the second well with the test separator; taking measurements via the commingle separator of a subset of the wells including the first well and not including the second well; determining an interpolated value of the first well; and using the interpolated value against the measurements of the commingle separator to determine a percentage of a total relating to the first well; each well is rotated through the test separator, the associated output values used to determine associated interpolated values for use with measurements taken via the commingle separator.

22 Claims, 6 Drawing Sheets

301

| 303 | 305 | | | | | 307 | 309 | | | | 311 | 313 | | | | 315 | | | | 317 | | | |
|---|---|---|---|---|---|---|---|---|---|---|---|---|---|---|---|---|---|---|---|---|---|---|---|
| Time Period | Reported Rates | | | | | Commingled Separator Measured Rate | Test Separator Measured Rates | | | | Total | Well Interpolated Rates | | | | Oil Rate Allocations | | | | Well Mode | | | |
| | A | B | C | D | Total | Common | A | B | C | D | | A | B | C | D | A | B | C | D | A | B | C | D |
| 1 | X | | | | | | Y | | | | | | | | | 100% | | | | T | C | C | C |
| 2 | | | | | | | | | | | | | | | | | | | | | | | |
| 3 | | | | | | | | | | | | | | | | | | | | | | | |
| 4 | | | | | | | | | | | | | | | | | | | | | | | |

FIG. 3

FLOWBACK MONITORING SYSTEM AND METHODS

RELATED APPLICATIONS

This application claims priority to U.S. Application No. 63/264,017, filed Nov. 12, 2021, which is incorporated by reference in its entirety herein.

FIELD OF THE DISCLOSURE

The disclosure relates generally to the field of oil well flowback monitoring. More specifically, the disclosure relates to using computerized processes to increase efficiencies of the flowback monitoring process.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the embodiments described herein relate to a method of well flowback monitoring, the method including connecting a number of wells to a test separator and a commingle separator such that the number of wells are in selective fluid connection with the test separator and the commingle separator, wherein the number of wells is greater than one; monitoring the number of wells via the test separator and the commingle separator and a computing system, the monitoring the number of wells including: coupling a first well of the number of wells to the test separator, wherein the first well is solitarily coupled to the test separator; measuring a plurality of output values of the first well via the test separator for a first predetermined measurement period; recording and analyzing the plurality of output values of the first well via the computing system; coupling the first well to the commingle separator, wherein the first well is no longer in fluid connection with the test separator; coupling a second well of the number of wells to the test separator, wherein the second well is solitarily coupled to the test separator; measuring a plurality of output values of the second well with the test separator for a second predetermined measurement period; recording and analyzing the plurality of output values of the second well via the computing system; taking measurements via the commingle separator of a subset of the number of wells, the subset including the first well and not including the second well, the measurements relating to data associated with the subset of the number of wells; determining an interpolated value of the first well based on the plurality of output values of the first well; and using the interpolated value of the first well against the measurements relating to data associated with the subset of the number of wells to determine a percentage of a total of the measurements relating to the first well; wherein each well of the number of wells is rotated through the test separator for precise measuring of associated output values, the associated output values used to determine associated interpolated values for use with measurements taken via the commingle separator.

In some aspects, the embodiments described herein relate to a method, wherein the interpolated value is an average of the plurality of output values of the first well.

In some aspects, the embodiments described herein relate to a method, further including coupling the first well to the test separator for a second time, wherein the first well is solitarily coupled to the test separator; measuring a second plurality of output values of the first well via the test separator for a third predetermined measurement period; recording the second plurality of output values of the first well via the computing system; and updating the interpolated value of the first well based on the second plurality of output values.

In some aspects, the embodiments described herein relate to a method, further including modifying the interpolated value based on one or more predefined settings.

In some aspects, the embodiments described herein relate to a method, further including modifying the interpolated value in response to one or more operating conditions.

In some aspects, the embodiments described herein relate to a method, further including determining the one or more operating conditions through machine learning analysis of the computing system.

In some aspects, the embodiments described herein relate to a method, wherein the one or more operating conditions are user input.

In some aspects, the embodiments described herein relate to a method, wherein the plurality of output values of the first well and the plurality of output values of the second well are measurements selected from a group including a number of barrels of material flowing through the test separator; a pressure reading of material flowing through the test separator; a temperature reading of material flowing through the test separator; and a flow rate reading of material flowing through the test separator.

In some aspects, the embodiments described herein relate to a method, wherein the computing system is at least partially housed within one of the test separator and the commingle separator.

In some aspects, the embodiments described herein relate to a method, wherein the computing system is separate from the test separator and the commingle separator and is in remote data communication with the test separator and the commingle separator.

In some aspects, the embodiments described herein relate to a method, further including using a plurality of valves to selectively couple the number of wells with the test separator and the commingle separator.

In some aspects, the embodiments described herein relate to a method, further including connecting the number of wells with one or more storage tanks, the one or more storage tanks to receive material from the number of wells through the test separator and the commingle separator.

In some aspects, the embodiments described herein relate to a system for well flowback monitoring, the system including: a test separator; a commingle separator; a number of wells in selective fluid connection with both the test separator and the commingle separator, the number of wells is greater than one; a computing system in data communication with the test separator and the commingle separator, the computing system, test separator, and commingle separator monitor the number of wells; a plurality of output values of a first well of the number of wells as tested from the test separator for a predetermined measurement period, the plurality of output values tested while the first well is solitarily coupled to the test separator, and the plurality of output values of the first well recorded and analyzed via the computing system; a plurality of output values of a second well of the number of wells as tested from the test separator for a second predetermined measurement period, the plurality of output values tested while the second well is solitarily coupled to the test separator, and the plurality of output values of the second well recorded and analyzed via the computing system; a plurality of measurements taken from the commingle separator of a subset of the number of wells, the subset including the first well and not including the second well, the measurements relating to data associated with the subset of the number of wells; and an interpolated value of the first well based on the plurality of output values of the first well; wherein the interpolated value of the first well is used against the measurements relating to data associated with the subset of the number of wells to determine a percentage of a total of the measurements relating to the first well; and wherein each well of the number of wells is rotated through the test separator for precise measuring of associated output values, the associated output values used to determine associated interpolated values for use with measurements taken via the commingle separator.

In some aspects, the embodiments described herein relate to a system, wherein the interpolated value is an average of the plurality of output values of the first well.

In some aspects, the embodiments described herein relate to a system, further including a second plurality of output values of the first well as measured via the test separator for a third predetermined measurement period, as the first well is solitarily coupled to the test separator for a second time, the second plurality of output values recorded and analyzed via the computing system; wherein the second plurality of output values is used to update the interpolated value of the first well.

In some aspects, the embodiments described herein relate to a system, further including one or more predefined settings used to modify the interpolated value either through user input or through operation of the computing system.

In some aspects, the embodiments described herein relate to a system, wherein the interpolated value is modified in response to one or more operating conditions.

In some aspects, the embodiments described herein relate to a system, wherein the one or more operating conditions are determined through machine learning analysis of the computing system.

In some aspects, the embodiments described herein relate to a system, wherein the one or more operating conditions are user input.

In some aspects, the embodiments described herein relate to a system, wherein the plurality of output values of the first well and the plurality of output values of the second well are measurements selected from a group including a number of barrels of material flowing through the test separator; a pressure reading of material flowing through the test separator; a temperature reading of material flowing through the test separator; and a flow rate reading of material flowing through the test separator.

In some aspects, the embodiments described herein relate to a system, wherein the computing system is at least partially housed within one of the test separator and the commingle separator.

In some aspects, the embodiments described herein relate to a system, wherein the computing system is separate from the test separator and the commingle separator and in remote data communication with the test separator and the commingle separator.

In some aspects, the embodiments described herein relate to a system, further including a plurality of valves to selectively couple the number of wells with the test separator and the commingle separator.

In some aspects, the embodiments described herein relate to a system, further including a storage tank fluidly connected to the test separator and the commingle separator, the storage tank receives material from the number of wells through the test separator and the commingle separator.

BRIEF DESCRIPTION OF THE SEVERAL VIEWS OF THE DRAWINGS

Illustrative embodiments of the present disclosure are described in detail below with reference to the attached drawing figures.

FIG. 3 shows an example spreadsheet of data of the flowback monitoring system of FIG. 1.

DETAILED DESCRIPTION

Figure 1:
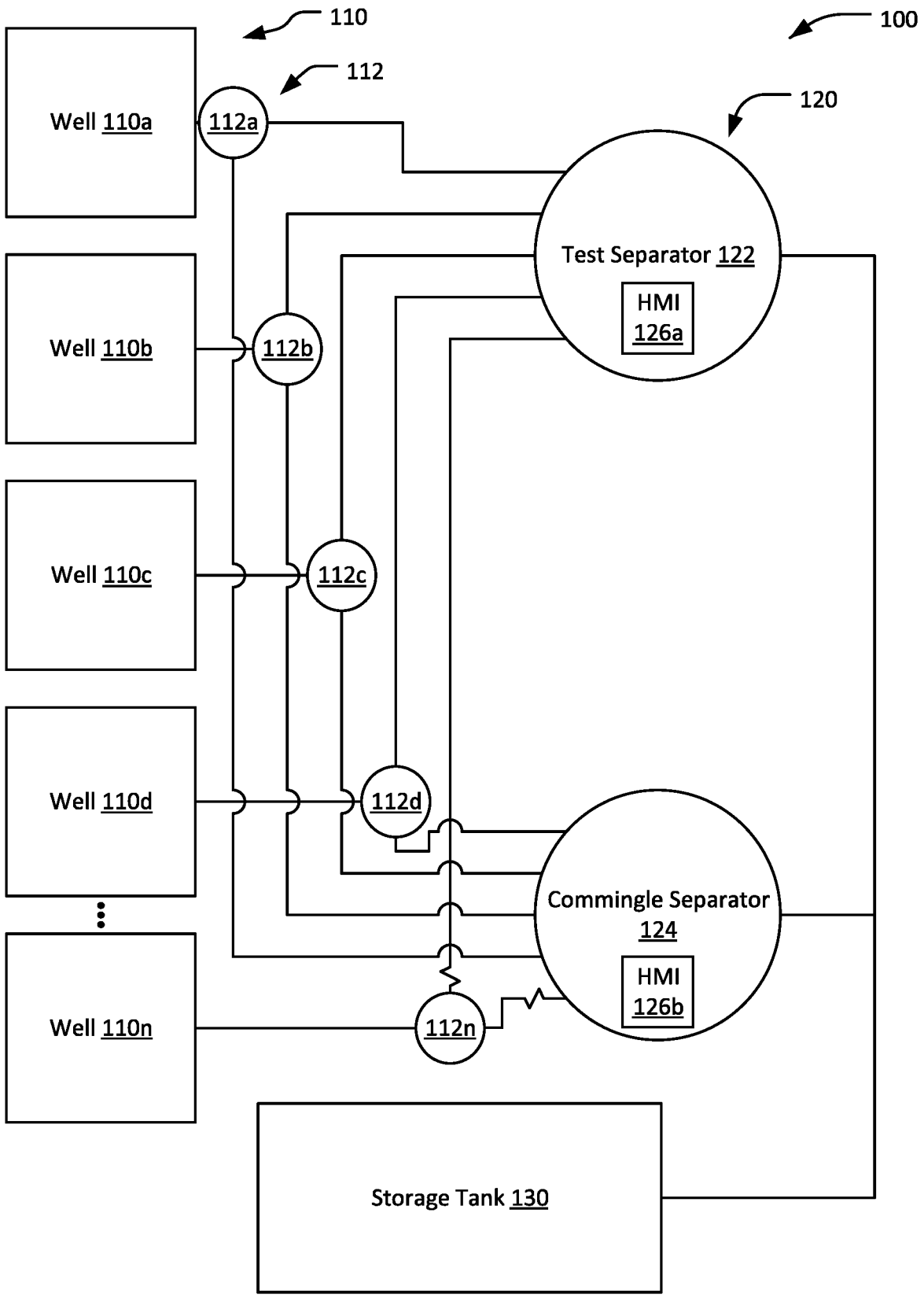
FIG. 1 schematically shows an example flowback monitoring system, according to an embodiment.

Flowback systems and methods are known in the art. Typically, these flowback systems are used after a well bore (e.g., for drilling oil, natural gas, etc.) has been established. Establishing a well bore involves injecting proppants (e.g., sand) and other fluids such as water into the well to ready it for extraction of the hydrocarbons. Before the well site can be used for regular oil/natural gas production, these excess contaminants must first be extracted. Flowback devices such as separators (each of which may include a high-pressure separator and a low-pressure separator, as is known in the art) are used to extract this combination of oil, natural gas, water, and/or proppants until satisfactory amounts of water and proppants are removed from the well site. Regular oil/natural gas production may commence thereafter. The artisan understands that it is desirable to remove sand prior to entering a processing facility because sand is erosive, can damage equipment, and may create production losses.

A well site may comprise a plurality of wells. Conventionally, during flowback, each of these wells is associated with a separator device, where proppants, water, oil, and/or natural gas are separated and measured. Each well may produce different volumes and concentrations of each of these materials, and these amounts may vary over time. It is desirable to know these quantities since they may indicate the viability of each well (e.g., indicate when each well is ready for regular production by ensuring the initial flowrate is not unsuitably high and/or there is not an undue amount of sand that is being extracted). Thus, it is beneficial to monitor and measure the materials being extracted during flowback.

Monitoring the operations of each of these wells during flowback is no easy task. Typically, each of the separators associated with each of the wells is configured to measure the characteristics of the material (e.g., volume of each material, type of each material, flowrate of each material, temperature, pressure, etc.) collected from the well. Each well in the prior art is associated with a solitary separator during the flowback process as this one-to-one correspondence allows for data of each well to be easily captured using measurements taken at the separator associated with each individual well. This prior art practice of using one separator for each well may be costlier and less efficient than using one separator for multiple wells. If multiple wells are fluidly coupled to the same separator, it may become difficult to identify flowback data of each well. For this reason, the prior art maintains a different separator for each well. The present disclosure may allow for multiple wells to be selectively fluidly coupled to the same separator while allowing for data associated with each well to be determined or estimated with suitably high precision. Using fewer separators than there are wells may reduce the costs associated with the flowback process and improve the efficiency of the flowback process.

Figure 4:
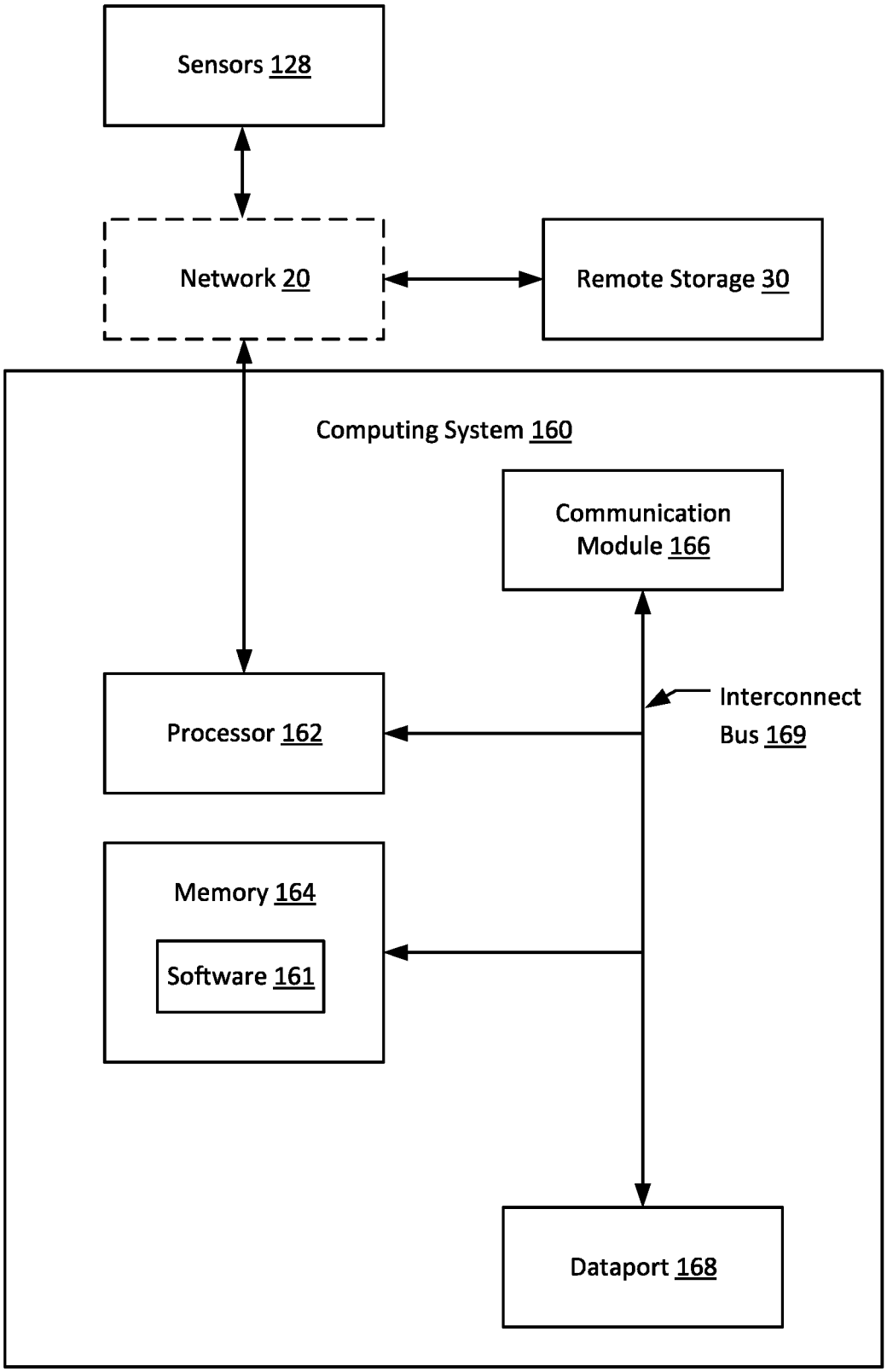
FIG. 4 schematically shows a computing system for use with the flowback monitoring system of FIG. 1.

FIGS. 1 through 5 depict and illustrate the workings of a flowback monitoring system 100, according to an example embodiment. As shown in FIG. 1, the flowback monitoring system 100, in this example, includes a test separator 122, a commingle separator 124, one or more storage tanks 130, and one or more computing systems 160 (FIG. 4). As also shown in FIG. 1, the flowback monitoring system 100 having its two separators 122 and 124 is being used to monitor flowback of more than two wells 110 (i.e., well 110*a*, 110*b*, 110*c*, 110*d*, and 110*n*). Well 110*n* indicates that the flowback of any number of wells may be monitored using the system 100. Further, while FIG. 1 shows two separators, teachings of the present disclosure are applicable to any system having X wells and Y separators where Y is less than X. The test separator 122 and the commingle separator 124 may collectively be referred to herein as separators 120.

The system 100 may be used to implement embodiments of a method 200 (FIG. 5), as detailed below. Each of the plurality of wells 110 is fluidly connected to the one or more storage tanks 130 via the plurality separators 120. In operation, the wells 110 may be used to extract material (e.g., natural gas, oil, water, proppants, such as sand and inorganic materials, etc.) from underground, and deliver said material to the separators 120. The separators 120 may process the received material by separating it into its individual components. The separators 120 may also monitor the processed material, such as measure an amount or volume of the material, identify the type of material, identify other characteristics of the material such as temperature and pressure, et cetera. Well Flowback rate may be controlled based on these characteristics in order to maximize production of hydrocarbons from the well. Once processed, the material may be routed to the one or more storage tanks 130. Monitoring of these wells 110 using a number of separators that is less than the number of wells being monitored may be achieved in an embodiment by implementing the method 200, as described in greater detail below. In embodiments, the number of separators 120 employed in the process may be related to the number of active wells 110 (e.g., two separators may be used for four wells, three separators may be used for 10 wells, et cetera).

Each of the plurality of wells 110 may comprise any suitable equipment now known or subsequently developed for extracting material, such as sand, other proppants, water, oil, natural gas, et cetera. The number of wells 110 used may be influenced by factors such as the amount of material to be extracted, size of the land that needs to be covered, size and characteristics of the reservoir, et cetera. Each of the wells 110 may be in selective communication with more than one of the plurality of separators 120. For example, as depicted in FIG. 1, each of the wells 110 are selectively coupled to both the test separator 122 and the commingle separator 124 via valves 112 (i.e., 112*a*-112*n*). As will become clear, each well 110*a*-110*n* will be fluidly coupled to only one of the test separator 122 and the commingle separator 124 at one time. The valves 112*a*-112*n* may allow for such selective fluid coupling to be effectuated (e.g., valve 112*a* may be placed in one position to fluidly couple the well 110*a* to the test separator 122 and may be placed in another position to fluidly couple the well 110*a* to the commingle separator 124). In some embodiments, the valves 112*a*-112*n* may be omitted and other means may be employed to switch each well 110*a*-110*n* from one separator to another as desired.

The separators 120 may comprise any suitable equipment now know or subsequently developed for receiving material, separating material, and measuring characteristics of the material extracted from the wells 110. The separators 120 may be coupled to one or more storage tanks 130 such that the material processed by the separators 120 may be stored therein. In embodiments, the separators 120 may be configured to route different constituents of the extracted material to different storage tanks 130 (e.g., the separators 120 may route oil to one storage tank 130, natural gas to another storage tank 130, water and/or proppants to yet another storage tank 130, et cetera). Alternately or additionally, the separators 120 may be configured to route one or more constituents directly to a sales line to a production facility. One or more of the separators 120 may have associated therewith a Human Machine Interface (HMI) (e.g., the test separator 122 may have an HMI 126*a* and the commingle separator 124 may have an HMI 126*b*). In operation, the HMIs 126*a*, 126*b* may house at least in part the computing system 160 and/or be communicatively coupled to the computing system 160, and may allow a user to manipulate the operation and/or the settings of the system 100, as will be described in greater detail below. The separators 120 may make use of one or more sensors 128 (FIG. 4) to measure the characteristics of the extracted material, e.g., the pressure, temperature, flow rate, density, etc., thereof.

Each of the separators 120 may be fluidly coupled to one or more of the wells 110 as chosen by the operator and/or the computing system 160. In embodiments, the test separator 122 may receive extracted material from only one well 110 at any given time, whereas the commingle separator 124 may receive the extracted material from multiple wells 110 (e.g., the remaining wells 110).

In operation, the wells 110 may be divided between the plurality of separators 120 for the processing of the material they extract. In embodiments, a single well 110 may correspond to the test separator 122, while the remaining wells 110 may correspond to the commingle separator 124. The wells 110 may be divided amongst the separators 120 via the valves 112, which the artisan will understand to be any suitable device or combination of devices for selectively directing material from one location to one or more other locations (e.g., automated valves, semi-automatic valves, et cetera). For instance, the valve 112*a* may direct the well 110*a* to the test separator 122, and the valves 112*b*, 112*c*, 112*d*, and 112*n* may direct wells 110*b*, 110*c*, 110*d*, and 110*n* to the commingle separator 124, respectively. Because only a single well 110 routes material to the test separator 122 at any given time, measurements at the test separator 112 may provide actual, precise, data for that solitary well 110 in granular detail. For example, the test separator 122 may measure characteristics such as volume, flowrate, temperature, pressure, and type of material extracted from the well 110 fluidly coupled thereto. This data may be routed to the computing system 160, where it may be stored and/or otherwise used, such as in the method 200. The commingle separator 124 may gather the same kind of material data, but measurements taken at the commingle separator 124 may be associated with the collective output of all the wells 110 fluidly coupled to the commingle separator 124 at that time. The commingle separator 124 may not be able to determine what portion and/or characteristics of the extracted material originated from which of the wells 110. For example, the commingle separator 124 may be accepting the output of four different wells 110, and the commingle separator 124 may measure an extracted material volume of forty barrels of oil. In this situation, the commingle separator 124 may not be able to distinguish if all four wells 110 are producing ten barrels of oil each, or if one well 110 is producing more oil than another well 110. As described, the prior art uses one-to-one correspondence between wells and separators for this reason. The present disclosure may allow for the outputs of each well to be characterized with reasonable certainty even where multiple wells are fluidly coupled to the same separator.

Figure 2A:
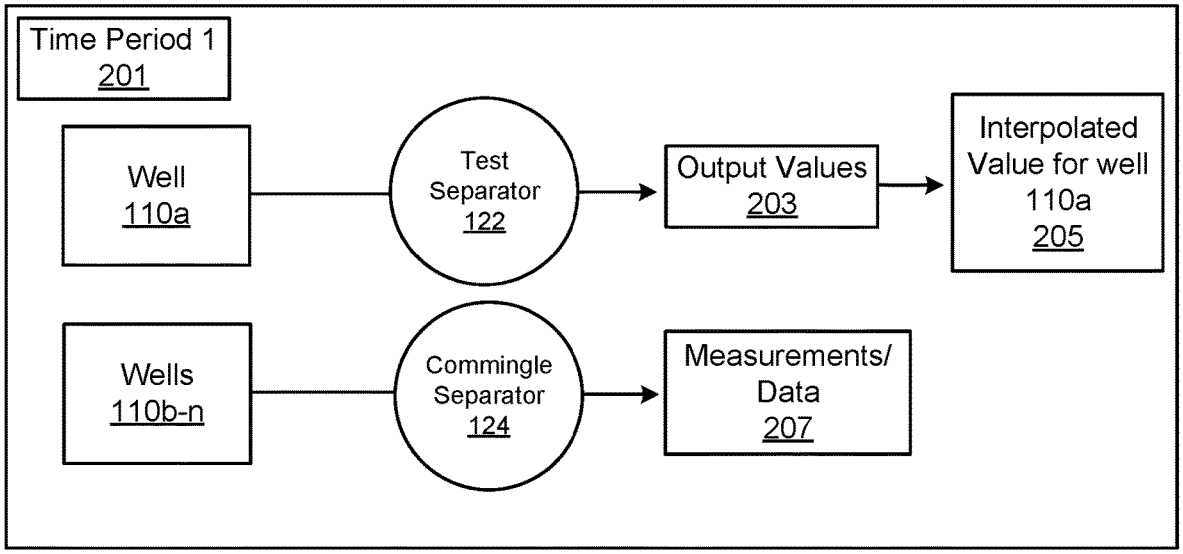
FIGS. 2A-2B schematically shows a first and second operational step of the flowback monitoring system of FIG. 1.
Figure 2B:
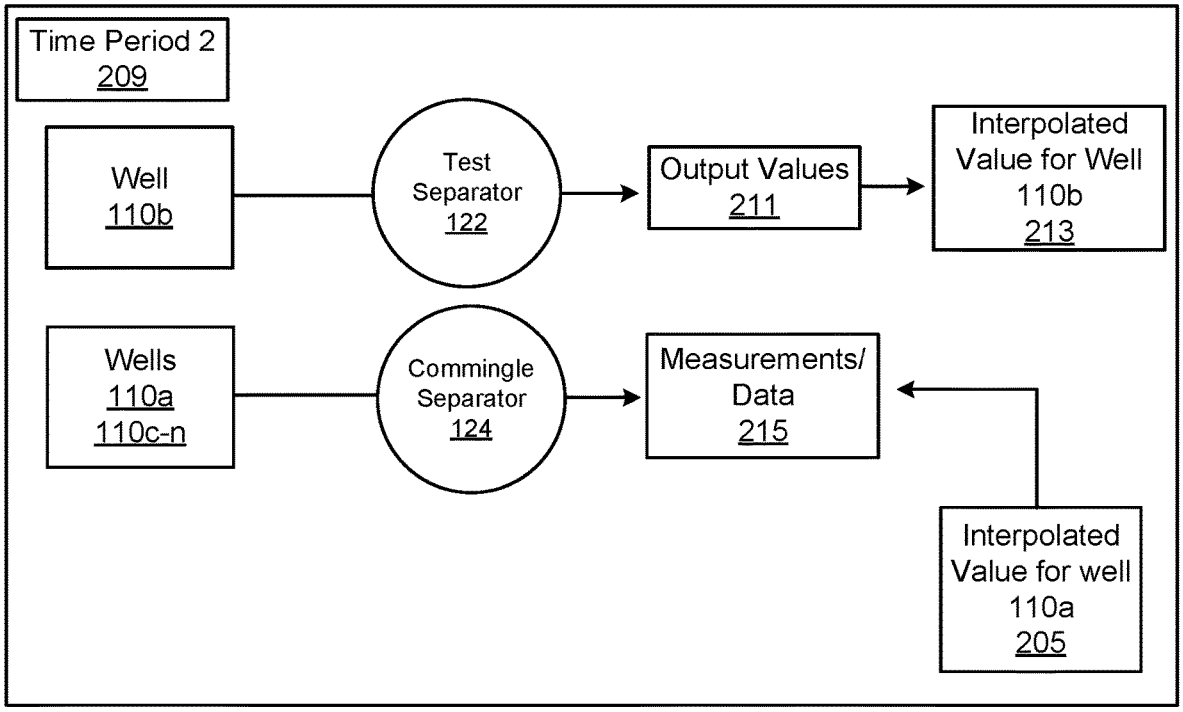

In FIGS. 2A and 2B, exemplary diagrams depict two operational measurement periods of embodiments of the present disclosure. The measurement periods shown are time periods, however, an artisan will understand that alternative means, such as a number of data points, may be used instead. In FIG. 2A, a first time period 201 is shown, wherein one of the wells 110*a* is solitarily coupled to the test separator 122 while the remaining wells 110*b-n* are coupled to the commingle separator 124. During the first time period 201, a plurality of precisely accurate output values 203 for well 110*a* are collected, stored, and analyzed via the computer system 160, the output values 203 used to establish one or more associated interpolated values 205 for well 110*a*. Meanwhile, during the first time period 201, the commingle separator collects collective measurements and data 207, from the remaining wells, these measurements and data being general to all material flowing through the commingle separator 124 from wells 110*b-n*.

As shown in FIG. 2B, during a second time period 209 (or other measurement period as would be understood), a second well 110*b* is switched to being solitarily coupled to the test separator 122, while the remaining wells 110*a* and 110*c-n* are coupled to the commingle separator 124. The test separator 122 collecting precise output values 211 for well 110*b* for generating an associated interpolated value 213 for well 110*b*. During this second time period 209, the commingle separator 124 will collect measurements and data 215 for the remaining wells 110*a* and 110*c-n*. As the interpolated value 205 for well 110*a* was already established in the first time period 201, this interpolated value 205 is then applied to the measurements and data 215 to determine a percentage of the totals that is associated with well 110*a*. These measurement periods continue until all wells have been solitarily comingled to the test separator. Further, the process continues to repeat such that the interpolated value for each well may be updated as further data is collected.

In an embodiment, the system 100 may make use of the algorithm and/or machine learning processes described herein. In FIG. 3, a simplified exemplary output spreadsheet 301 is shown. Here, wells 110*a*, 110*b*, 110*c*, and 110*d* are monitored using the test separator 122 and the common or commingle separator 124. At any given time, the output of only one of the wells 110 is routed to the test separator 122, while the output of the other wells 110 is collectively routed to the commingle separator 124. After some period of time and/or a suitable amount of data is collected, the system 100 may use the valves 112 and the well 110 that is being handled by the test separator 122 may be rotated out with one of the wells 110 being routed to the commingle separator 124 (e.g., a well 110*a* that was fluidly coupled to the test separator 122 may be switched over to the commingle separator 124, and a well 110*b* that was fluidly coupled to the commingle separator 124 may be switched over to the test separator 122). This may be accomplished by, for example, using valve 112*a* to switch output of well 110*a*, and using valve 112*b* to switch output of well 110*b*, to cause the latter to be fluidly coupled to the test separator 122 and the former to be fluidly coupled to the commingle separator 124. The output of well 110*b* may be now measured using a separator that has a one-to-one correspondence with the well 110*b*. In this way, after a period of time, each of the well 110 outputs may eventually be individually measured at the test separator 122. As shown, the spreadsheet may organize measurements based on time periods 303, which may be any time period an artisan may deem appropriate, such as measurements reported every hour, every day, or every minute, as examples. Further, while FIG. 3 illustrates a spreadsheet 301 that illustrate the workings of the system 100 in connection with oil, the artisan will readily understand the teachings are likewise applicable to estimate other outputs (e.g., natural gas, water, et cetera).

As shown in FIG. 3, in embodiments, the data is divided into columns for Reported Rates 305, Commingled Separator Measured Rate 307, Test-Separator Measure Rates 309, a Total 311, Well Interpolated Rates 313, Oil Rate Allocations 315, and Well Mode 317. FIG. 3 shows well 110*a* as well A, well 110*b* as well B, well 110*c* as well C, and well 110*d* as well D. An artisan would understand the exact titles, and layout of data may vary.

Accordingly, the spreadsheet 301 may show the reported rates 305 organized by well, and as a total. The reported rates 305 will include a precisely measured rate for the well connected to the test separator 122 and interpolated measured rates for the remaining wells connected to the commingle separator 124 as determined via the well interpolated rates 313. For example, when well 110*a* is connected to the test separator 122, the value "X" will be the same as the value "Y" under the test separator measured rates 309. Further, during time period 1, the well mode 317 would indicate a "T" as associated with well 110*a*. The remaining wells 110*b-d* being there identified with a "C" for indicating connection to the commingle separator 124.

The reported rates 305 for wells 110*b-d* will be based off of the commingled separator measured rate 307 as analyzed via the well interpolated rates 313. Here, the total 311 is the total of all wells, including the commingled separator measured rate 307 and the test separator measure rate 309. And lastly, the oil rate allocations 315 will show a percentage of totals for each well. For example, when well 110*a* is coupled to the test separator 122, the associated oil rate allocations 315 will be 100%. The remaining wells 110*b-d* being coupled to the commingle separator 124, the associated oil rate allocations 315 for B, C, and D would sum to 100%. The oil rate allocations 315 further showing a percentage of the total commingled separator measured rate 307 for the remaining wells 110*b-d*. These percentages may then be applied against the total measured value at the commingle separator 124 to calculate the portion of the measured total attributable to each of the wells 110*b*, 110*c*, and 110*d*

As each well 110*a-n* is solitarily coupled to the test separator 122, the spreadsheet 301 will continue to gain data and the well interpolated rates 315 may further adapt to provide more accurate reported rates 305. Because each well was coupled to the test separator 122 at a prior point in time, actual prior data for each well is available. This data of each well from the prior point in time may be used to interpolate the current data of each well fluidly coupled to the commingle separator 124.

The interpolated value for a well 100 (e.g., well 110*b*) fluidly coupled to the commingle separator 124 may be determined by, for example, finding the average measured output for that well 110 while it was being directly measured by the test separator 122 for a period of time (e.g., four hours, six hours, et cetera). In some cases, as discussed herein, the interpolated value may be different than an average yield of the well while it was coupled to the test separator 122.

Turning now to an example scenario, the interpolated values of wells 110*b*, 110*c*, and 110*d* for rows 1 through 4 are twenty, twenty-one, and twenty-three barrels, respectively. These values were all interpolated from actual data (i.e., data that was previously obtained while each of these wells 110*b*, 110*c*, and 11*d* were coupled to the test separator 122). The total interpolated value of these three wells 110 is equal to sixty-four barrels (i.e., 20+21+23=64). With this total interpolated value, the percentage or ratio of the total that is made up by each of the wells 110 may be found. In this case, wells 110*b*, 110*c*, and 110*d* make up 31.25%, 32.81%, and 35.94%, respectively, of the total interpolated value. These percentages may then be applied against the total measured value at the commingle separator 124 to calculate the portion of the measured total attributable to each of the wells 110*b*, 110*c*, and 110*d*. In row 1 of the spreadsheet 301, this would result in wells 110*b*, 110*c*, and 110*d* providing 20.31, 21.33, and 23.36 barrels of oil, respectively, of an example measured total of sixty-five barrels. Thus, for the first row of FIG. 2A, the reported values for wells 110*a*, 110*b*, 110*c*, and 11*d* may come out to be 15.00 (as measured), 20.31 (as interpolated), 21.33 (as interpolated), and 23.36 (as interpolated) barrels of oil, respectively. This process may be repeated as many times as desired. For example, the process may be carried out another three times while well 110*a* is fluidly connected to the test separator 122.

After a suitable amount of data is collected (e.g., after four hourly data points), the system 100 may use the valves 112 to rotate out the well coupled to the test separator 122. In this example, at row 5 of the spreadsheet 301, well 110*b* may be switched to the test separator 122, and well 110*a* may be switched to the commingle separator 124 (together with wells 110*c* and 110*d* which were already fluidly coupled to the commingle separator 124). This may be accomplished by, for example, using valve 112*a* to switch output of well 110*a*, and using valve 112*b* to switch output of well 110*b*, to cause the latter to be fluidly coupled to the test separator 122 and the former to be fluidly coupled to the commingle separator 124. The output of well 110*b* may be now measured using a separator that has a one-to-one correspondence with the well 110*b*. Using the data collected in rows one through four when well 110*a* was fluidly coupled to the test separator 122, the output value for well 110*a* may be interpolated. In this case, example measured values of fifteen, ten, twelve, and ten may be averaged (or otherwise computed, as discussed herein) to yield an interpolated value of 11 barrels for well A at the example time (row 5). The output values of each of the wells 110 may then be determined using the techniques described above, using the newly measured data of well 110*b* and the interpolated values of well 110*a*.

This process may be continually repeated. Each of the wells 110 may periodically (or after varying intervals of time) be fluidly coupled to the test separator 122 so that actual measurements of these wells are taken, and subsequently, the actual measurements of each well may be used to interpolate the output of that well when that well is coupled to the commingle separator 124.

It will readily be understood by an artisan that spreadsheet 301 is merely exemplary; in other embodiments, other means of data presentation may be used, varying time periods or other means may be used. The amount of data points used for each cycle, or period before the test separator 122 switches to another well 110, may be user selected and/or determined by the computing system 160. For example, each cycle may last three data points, four data points, six data points, ten data points, twenty-four data points, etc., and may even be changed during system 100 operation.

While the interpolated value used in FIG. 3 may be a direct average of the previously measured cycle of values for a given well, other embodiments may employ different methods to find the interpolated value. For instance, any suitable type of interpolation method may be used to arrive at the interpolated value using the data measured at the test separator 122. In some embodiments, the interpolation value may be biased by user and/or computing system 160 selected settings. For instance, the direction and/or magnitude of rounding numbers may be modified. As another example, the computing system 160 may be configured to recognize a trend of the data and modify the final interpolated value accordingly. For example, in an instance where actual measured values of well 110*a* are fifteen, ten, twelve, and ten the computing system 160 may have recognized that the values measured were fifteen, ten, twelve, and ten, and recognized that the output of well 110*a* was trending downwards. In response, the computing system 160 may modify the interpolated value of 11.75 (average) down to eleven since, over the course of the next several cycles of data points, it would be likely that the observed trend would continue and well 110*a* may output less than an average of 11.75 barrels during that time. In embodiments, however, averaging of the well output while it was coupled to the test separator 122 may be a primary (or at least one) mechanism employed for interpolation.

In some embodiments, the interpolated value may be modified (e.g., by the computing system 160) in response to and based on a recognized operating condition. For example, if well 110*a* is being measured by the test separator 122, and wells 110*b*, 110*c*, and 110*d* are being collectively measured by the commingle separator 124 and the measured values for well 110*a* for a time period are zero, zero, two, six, five, six, seven, and seven barrels of oil. This averages out to a value of 4.13, however, a value of seven is chosen as the interpolated value of well 110*a* after its cycle is complete and the test separator 122 begins measuring well 110*b*. The interpolated value may be modified to seven in this case because the computing system 160 may recognize that well 110*a* is in a "startup" condition and therefore sharply trending upwards. In response to a determination of this startup condition, the computing system 160 may modify the interpolation value found by truncating the data set measured to eliminate the low flow values, by selecting the largest or last data point measured, et cetera. Other methods of modifying the interpolated values found in response to various operating conditions are contemplated herein and part of the disclosure, such as modifying interpolated values in light of detected blockage conditions, over-pressured conditions, wind-down conditions, user input, et cetera.

Using the above-described techniques and their embodiments, a plurality of wells 110 may be accurately monitored using a plurality (e.g., a relatively smaller plurality) of separators 120. The artisan may recognize that any suitable number of wells 110 may be used with any suitable number of separators 120, so long as at least one test separator 122 is used to periodically (or after irregular intervals of time) measure the output of each well on a one-to-one basis. In embodiments, the test separator 122 and commingle separator 124 may be functionally identical (i.e., the commingle separator may be converted to a test separator by fluidly coupling a solitary well thereto). In embodiments, and depending on the number of wells, multiple test separators and/or commingle separators may be employed. While barrels of oil are used as the data point in exemplary embodiments herein, it is to be understood that other values and materials may likewise be employed. For example, alternately or in addition, pressure, temperature, and/or flow rate may be used. The artisan would also understand that while these techniques, methods, and systems are illustrated using oil, these same techniques, systems, and methods may be applied towards monitoring other materials, such as water, proppants (e.g., sand), and/or natural gas.

FIG. 4 is a functional block diagram of the computing system 160 which may be used to implement the various flowback monitoring system embodiments and methods according to the different aspects of the present disclosure. The computing system 160 may be, for example, a smartphone, a laptop computer, a desktop computer, a flexible circuit board, or other computing device whether now known or subsequently developed. In embodiments, the computing system is housed at least in part within one or more of the separators 120; in other embodiments, the computing system is remote from the separators 120 and in data communication therewith. The computing system 160 comprises a processor 162, the memory 164, a communication module 166, and a dataport 168. These components may be communicatively coupled together by an interconnect bus 169. A user may interact with the computing system 160 via the HMIs 126*a*, 126*b* located at the separators 120, for example. The artisan will understand the HMIs 126*a*, 126*b* may comprise input and output devices, e.g., a touch screen, a keyboard, a display, et cetera.

The processor 162 may include any processor used in smartphones and/or other computing devices, including an analog processor (e.g., a Nano carbon-based processor) or a digital processor. In certain embodiments, the processor 162 may include one or more other processors, such as one or more microprocessors, and/or one or more supplementary co-processors, such as math co-processors.

The memory 164 may include both operating memory, such as random access memory (RAM), as well as data storage, such as read-only memory (ROM), hard drives, optical, flash memory, or any other suitable memory/storage element. The memory 164 may include removable memory elements, such as a CompactFlash card, a MultiMediaCard (MMC), and/or a Secure Digital (SD) card. In certain embodiments, the memory 164 includes a combination of magnetic, optical, and/or semiconductor memory, and may include, for example, RAM, ROM, flash drive, and/or a hard disk or drive. The processor 162 and the memory 164 each may be located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 162 may be connected to the memory 164 via the dataport 168.

The communication module 166 may be configured to handle communication links between the computing system 160 and other external devices or receivers, and to route incoming/outgoing data appropriately. For example, inbound data from the dataport 168 may be routed through the communication module 166 before being directed to the processor 162, and outbound data from the processor 162 may be routed through the communication module 166 before being directed to the dataport 168. The communication module 166 may include one or more transceiver modules configured for transmitting and receiving data, and using, for example, one or more protocols and/or technologies, such as GSM, UMTS (3GSM), IS-95 (CDMA one), IS-2000 (CDMA 2000), LTE, FDMA, TDMA, W-CDMA, CDMA, OFDMA, Wi-Fi, WiMAX, 5G, or any other protocol and/or technology.

The dataport 168 may be any type of connector used for physically interfacing with a smartphone, computer, and/or other devices, such as a mini-USB port or an IPHONE®/IPOD® 30-pin connector or LIGHTNING® connector. In other embodiments, the dataport 168 may include multiple communication channels for simultaneous communication with, for example, other processors, servers, and/or client terminals.

The memory 164 may store instructions for communicating with other systems, such as a computer. The memory 164 may store, for example, a program (e.g., computer program code) adapted to direct the processor 162 in accordance with the embodiments described herein. The instructions also may include program elements, such as an operating system. While execution of sequences of instructions in the program causes the processor 162 to perform the process steps described herein, hard-wired circuitry may be used in place of, or in combination with, software/firmware instructions for implementation of the processes of the present embodiments. Thus, unless expressly noted, the present embodiments are not limited to any specific combination of hardware and software.

In embodiments, the memory 164 includes software 161. The software 161 may contain machine-readable instructions configured to be executed by the processor 162. The software 161 may, for example, process data obtained from the sensor 128. In embodiments, the software 161 may cause the computing system 160 to dynamically respond to a reading obtained by the sensor 128. For example, the software 161 may direct the valves 112 to close in response to a sensor 128 determination that dangerous operating conditions are present. As another example, the software 161 may direct the valves 112 to switch which of the wells 110 is connected to the test separator 122 and which of the wells 110 are connected to the commingle separator 124.

In embodiments, the memory 164 may contain a machine learning system or program configured to carry out one or more of the techniques and methods described herein. As an example, a machine learning program may be used by the computing system 160 to recognize various operating conditions of the system 100, and to formulate a response to said detections (e.g., by modifying the interpolated value calculated from the measured data set). The machine learning analysis may be provided on behalf of any number of machine learning algorithms and trained models, including but not limited to deep learning models (also known as deep machine learning, or hierarchical models) that have been trained to perform image recognition tasks. Machine learning is used to refer to the various classes of artificial intelligence algorithms and algorithm-driven approaches that are capable of performing machine-driven (e.g., computer-aided) identification of trained structures, and deep learning is used to refer to a multiple-level operation of such machine learning algorithms using multiple levels of representation and abstraction. The artisan will understand that the role of the machine learning algorithms that are applied, used, and configured as described may be supplemented or substituted by any number of other algorithm-based approaches, including variations of artificial neural networks, learning-capable algorithms, trainable object classifications, and other artificial intelligence processing techniques.

The computing system 160 may be in data communication with a remote storage 30 over a network 20. The network 20 may be a wired network, a wireless network, or comprise elements of both. In embodiments, the network 20 may communicatively link one or more components of the flowback monitoring system 100. For example, the sensor 128 may be communicatively linked to the computing system 160 via the network 20 for the exchange of information therebetween. The remote storage 30 may be, for example, the "cloud" or other remote storage in communication with other computing systems. In embodiments, data (e.g., readings obtained by the sensors 128 and the separators 120, and the dynamic responses of the computing system 160 thereto) may be stored in the remote storage 30 for analytics.

Figure 5:
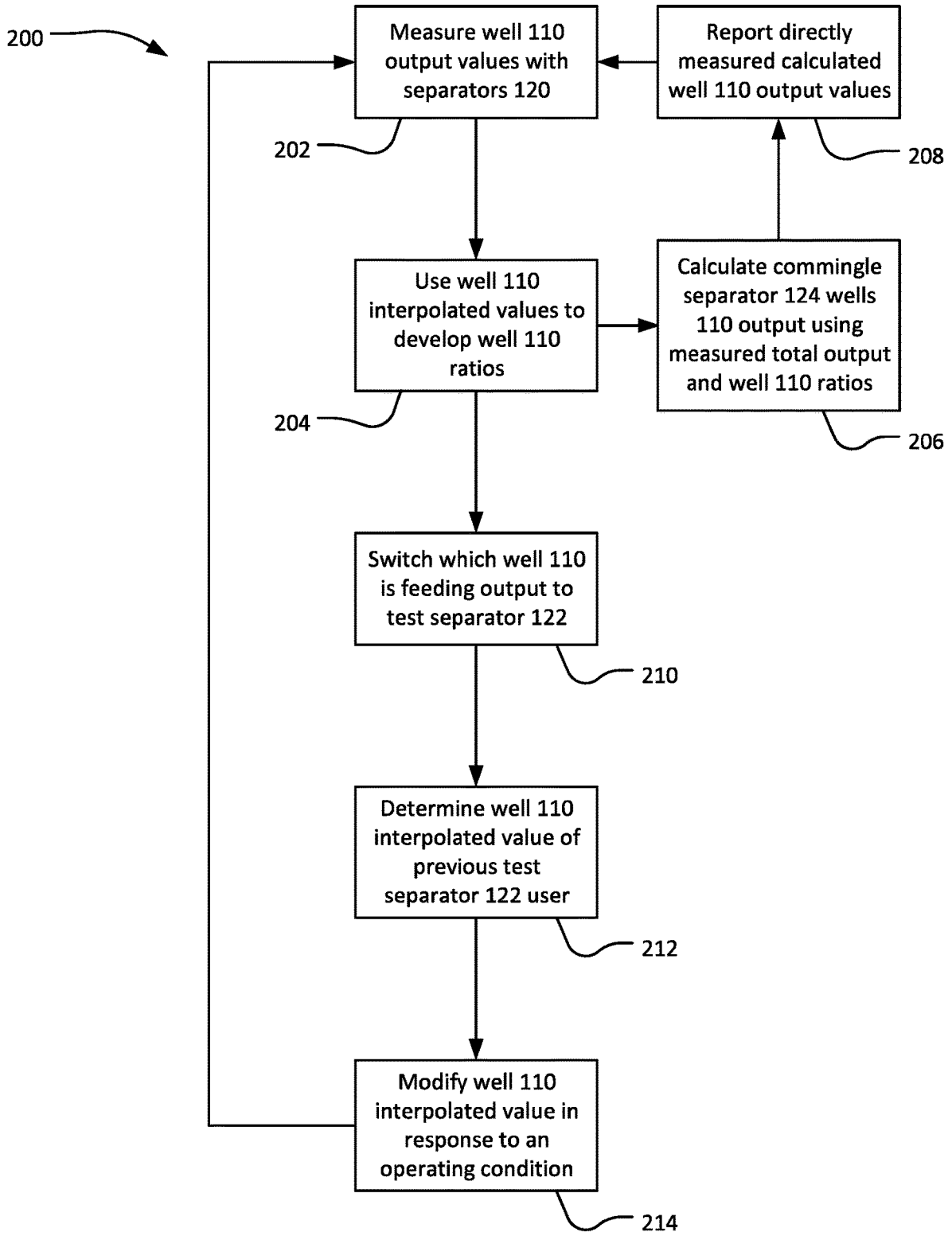
FIG. 5 shows a flowchart illustrating a method of using the flowback monitoring system of FIG. 1, according to an embodiment.

FIG. 5 is a flowchart depicting a method 200 of operating the flowback monitoring system 100, in an example embodiment. First, at step 202, well 110 outputs may be measured using the separators 120. For example, the output of one well 110 may be directly measured at test separator 122, while the total output of the other wells 110 may be measured at the commingle separator 124. Next, at step 204, interpolated values of the wells (interpolated as described herein) may be used, along with the measurements of the commingle separator 124, to calculate the contribution ratio of each well to the commingle separator 124. Then, at step 206, the calculated ratios may be applied against the actual measured collective total at the commingle separator 124 to estimate the individual output of each of the comingled wells 110. At step 208, each of the well 110 output values found may be reported (e.g., to a client, to a database, et cetera).

Once a cycle is complete, or at an otherwise determined point of time, the valves 112 may be used to switch which well 110 is feeding its output to the test separator 122, at step 210. In operation, one well 110 may transfer from the test separator 122 to the commingle separator 124, while a different well 110 may generally simultaneously transfer from the commingle separator 124 to the test separator 122. Then, at step 212, an interpolated value for the well 110 which was previously coupled to the test separator 122 is determined. This value may be found as described above, such as through interpolation methods (e.g., smart linear averaging). At step 214, the determined interpolated value found in step 212 may be modified. For example, the computing system 160 may recognize an operating condition (e.g., a startup condition), and modify the interpolated value from step 212 in response.

Each of the steps 202 through 208 may be repeated as many times as desired to complete a "cycle." For instance, steps 202 through 208 may be repeated four times, as shown in FIG. 2A, to complete a cycle before initiating step 210. Likewise, steps 210 through 214 may be repeated as many times as desired. For example, FIG. 2A shows a scenario where steps 210 through 214 are executed five times, once after each cycle of steps 202 through 208 are completed.

It is to be understood that the steps of the method 200 need not be carried out in the exact order as described, that some steps may occur simultaneously with other steps, that some steps may be optional, and that each of these combinations of carrying out the method 200 are within the scope of the present disclosure. For example, the step of modifying the interpolated value in response to a detected operating condition (e.g., step 214) may be skipped where no operating condition is detected. As another example, one or more wells 110 may be offline when the method 200 is started, and thus the method 200 may be modified to accommodate additional wells.

As mentioned above, using the flowback monitoring system 100 to deliver extraction information to a user may advantageously avoid some or all of the issues normally associated with operating a plurality of flowback wells. For instance, the number of separators required to operate the plurality of wells may be reduced. In other words, cost and logistical complications may be minimized because there may be less separators than there are wells.

While flowback well applications were primarily used herein to provide context for the various flowback monitoring system functions, the artisan would understand that the systems 100 disclosed herein may be adapted to other suitable application functions, and that such adaptions are within the scope of the present disclosure.

The artisan will understand that the flowback monitoring system 100 disclosed herein may include or have associated therewith electronics (e.g., the computing system 160, the sensors 128, et cetera). The electronics may be used to control and modify the operation of the flowback monitoring system 160 (e.g., to change the timing of the system 100, to turn the system 100 on and off, to dynamically control the system 100 in response to a sensor 128/separator 120 detection, et cetera). In some example embodiments, the processor or processors may be configured through particularly configured hardware, such as an application specific integrated circuit (ASIC), field-programmable gate array (FPGA), etc., and/or through execution of software to allow the diving tank apparatus 100 to function in accordance with the disclosure herein.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A method of well flowback monitoring, the method comprising:

connecting a number of wells to a test separator and a commingle separator such that the number of wells are in selective fluid connection with the test separator and the commingle separator, wherein the number of wells is greater than one; and monitoring the number of wells via the test separator and the commingle separator and a computing system, the monitoring the number of wells including:

coupling a first well of the number of wells to the test separator, wherein the first well is solitarily coupled to the test separator;

measuring a plurality of output values of the first well via the test separator for a first predetermined measurement period;

recording and analyzing the plurality of output values of the first well via the computing system;

coupling the first well to the commingle separator, wherein the first well is no longer in fluid connection with the test separator;

coupling a second well of the number of wells to the test separator, wherein the second well is solitarily coupled to the test separator;

measuring a plurality of output values of the second well with the test separator for a second predetermined measurement period;

recording and analyzing the plurality of output values of the second well via the computing system;

taking measurements via the commingle separator of a subset of the number of wells, the subset including the first well and not including the second well, the measurements relating to data associated with the subset of the number of wells;

determining an interpolated value of the first well based on the plurality of output values of the first well; and using the interpolated value of the first well against the measurements relating to data associated with the subset of the number of wells to determine a percentage of a total of the measurements relating to the first well;

wherein each well of the number of wells is rotated through the test separator for precise measuring of associated output values, the associated output values used to determine associated interpolated values for use with measurements taken via the commingle separator; and wherein the interpolated value is an average of the plurality of output values of the first well.

2. The method of claim 1, further comprising modifying the interpolated value based on one or more predefined settings.

3. The method of claim 1, wherein the plurality of output values of the first well and the plurality of output values of the second well are measurements selected from a group consisting of:

a number of barrels of material flowing through the test separator;

a pressure reading of material flowing through the test separator;

a temperature reading of material flowing through the test separator; and a flow rate reading of material flowing through the test separator.

4. The method of claim 1, wherein the computing system is separate from the test separator and the commingle separator and is in remote data communication with the test separator and the commingle separator.

5. The method of claim 1, further comprising using a plurality of valves to selectively couple the number of wells with the test separator and the commingle separator.

6. The method of claim 1, further comprising connecting the number of wells with one or more storage tanks, the one or more storage tanks to receive material from the number of wells through the test separator and the commingle separator.

7. A method of well flowback monitoring, the method comprising:

connecting a number of wells to a test separator and a commingle separator such that the number of wells are in selective fluid connection with the test separator and the commingle separator, wherein the number of wells is greater than one; and monitoring the number of wells via the test separator and the commingle separator and a computing system, the monitoring the number of wells including:

coupling a first well of the number of wells to the test separator, wherein the first well is solitarily coupled to the test separator;

measuring a plurality of output values of the first well via the test separator for a first predetermined measurement period;

recording and analyzing the plurality of output values of the first well via the computing system;

coupling the first well to the commingle separator, wherein the first well is no longer in fluid connection with the test separator;

coupling a second well of the number of wells to the test separator, wherein the second well is solitarily coupled to the test separator;

measuring a plurality of output values of the second well with the test separator for a second predetermined measurement period;

recording and analyzing the plurality of output values of the second well via the computing system;

taking measurements via the commingle separator of a subset of the number of wells, the subset including the first well and not including the second well, the measurements relating to data associated with the subset of the number of wells;

determining an interpolated value of the first well based on the plurality of output values of the first well;

using the interpolated value of the first well against the measurements relating to data associated with the subset of the number of wells to determine a percentage of a total of the measurements relating to the first well;

coupling the first well to the test separator for a second time, wherein the first well is solitarily coupled to the test separator;

measuring a second plurality of output values of the first well via the test separator for a third predetermined measurement period;

recording the second plurality of output values of the first well via the computing system; and updating the interpolated value of the first well based on the second plurality of output values;

wherein each well of the number of wells is rotated through the test separator for precise measuring of associated output values, the associated output values used to determine associated interpolated values for use with measurements taken via the commingle separator.

8. A method of well flowback monitoring, the method comprising:

connecting a number of wells to a test separator and a commingle separator such that the number of wells are in selective fluid connection with the test separator and the commingle separator, wherein the number of wells is greater than one; and monitoring the number of wells via the test separator and the commingle separator and a computing system, the monitoring the number of wells including:

coupling a first well of the number of wells to the test separator, wherein the first well is solitarily coupled to the test separator;

measuring a plurality of output values of the first well via the test separator for a first predetermined measurement period;

recording and analyzing the plurality of output values of the first well via the computing system;

coupling the first well to the commingle separator, wherein the first well is no longer in fluid connection with the test separator;

coupling a second well of the number of wells to the test separator, wherein the second well is solitarily coupled to the test separator;

measuring a plurality of output values of the second well with the test separator for a second predetermined measurement period;

recording and analyzing the plurality of output values of the second well via the computing system;

taking measurements via the commingle separator of a subset of the number of wells, the subset including the first well and not including the second well, the measurements relating to data associated with the subset of the number of wells;

determining an interpolated value of the first well based on the plurality of output values of the first well; and using the interpolated value of the first well against the measurements relating to data associated with the subset of the number of wells to determine a percentage of a total of the measurements relating to the first well;

wherein each well of the number of wells is rotated through the test separator for precise measuring of associated output values, the associated output values used to determine associated interpolated values for use with measurements taken via the commingle separator; and further comprising modifying the interpolated value in response to one or more operating conditions.

9. The method of claim 8, further comprising determining the one or more operating conditions through machine learning analysis of the computing system.

10. The method of claim 8, wherein the one or more operating conditions are user input.

11. A method of well flowback monitoring, the method comprising:

connecting a number of wells to a test separator and a commingle separator such that the number of wells are in selective fluid connection with the test separator and the commingle separator, wherein the number of wells is greater than one; and monitoring the number of wells via the test separator and the commingle separator and a computing system, the monitoring the number of wells including:

coupling a first well of the number of wells to the test separator, wherein the first well is solitarily coupled to the test separator;

measuring a plurality of output values of the first well via the test separator for a first predetermined measurement period;

recording and analyzing the plurality of output values of the first well via the computing system;

coupling the first well to the commingle separator, wherein the first well is no longer in fluid connection with the test separator;

coupling a second well of the number of wells to the test separator, wherein the second well is solitarily coupled to the test separator;

measuring a plurality of output values of the second well with the test separator for a second predetermined measurement period;

recording and analyzing the plurality of output values of the second well via the computing system;

taking measurements via the commingle separator of a subset of the number of wells, the subset including the first well and not including the second well, the measurements relating to data associated with the subset of the number of wells;

determining an interpolated value of the first well based on the plurality of output values of the first well; and using the interpolated value of the first well against the measurements relating to data associated with the subset of the number of wells to determine a percentage of a total of the measurements relating to the first well;

wherein each well of the number of wells is rotated through the test separator for precise measuring of associated output values, the associated output values used to determine associated interpolated values for use with measurements taken via the commingle separator; and wherein the computing system is at least partially housed within one of the test separator and the commingle separator.

12. A system for well flowback monitoring, the system comprising:

a test separator;

a commingle separator;

a number of wells in selective fluid connection with both the test separator and the commingle separator, the number of wells is greater than one;

a computing system in data communication with the test separator and the commingle separator, the computing system, test separator, and commingle separator monitor the number of wells;

a plurality of output values of a first well of the number of wells as tested from the test separator for a predetermined measurement period, the plurality of output values tested while the first well is solitarily coupled to the test separator, and the plurality of output values of the first well recorded and analyzed via the computing system;

a plurality of output values of a second well of the number of wells as tested from the test separator for a second predetermined measurement period, the plurality of output values tested while the second well is solitarily coupled to the test separator, and the plurality of output values of the second well recorded and analyzed via the computing system;

a plurality of measurements taken from the commingle separator of a subset of the number of wells, the subset including the first well and not including the second well, the measurements relating to data associated with the subset of the number of wells; and an interpolated value of the first well based on the plurality of output values of the first well;

wherein the interpolated value of the first well is used against the measurements relating to data associated with the subset of the number of wells to determine a percentage of a total of the measurements relating to the first well;

wherein each well of the number of wells is rotated through the test separator for precise measuring of associated output values, the associated output values used to determine associated interpolated values for use with measurements taken via the commingle separator; and wherein the interpolated value is an average of the plurality of output values of the first well.

13. The system of claim 12, further comprising one or more predefined settings used to modify the interpolated value either through user input or through operation of the computing system.

14. The system of claim 12, wherein the plurality of output values of the first well and the plurality of output values of the second well are measurements selected from a group consisting of:

a number of barrels of material flowing through the test separator;

a pressure reading of material flowing through the test separator;

a temperature reading of material flowing through the test separator; and a flow rate reading of material flowing through the test separator.

15. The system of claim 12, wherein the computing system is separate from the test separator and the commingle separator and in remote data communication with the test separator and the commingle separator.

16. The system of claim 12, further comprising a plurality of valves to selectively couple the number of wells with the test separator and the commingle separator.

17. The system of claim 12, further comprising a storage tank fluidly connected to the test separator and the commingle separator, the storage tank receives material from the number of wells through the test separator and the commingle separator.

18. A system for well flowback monitoring, the system comprising:

a test separator;

a commingle separator;

a number of wells in selective fluid connection with both the test separator and the commingle separator, the number of wells is greater than one;

a computing system in data communication with the test separator and the commingle separator, the computing system, test separator, and commingle separator monitor the number of wells;

a first plurality of output values of a first well of the number of wells as tested from the test separator for a predetermined measurement period, the plurality of output values tested while the first well is solitarily coupled to the test separator, and the plurality of output values of the first well recorded and analyzed via the computing system;

a plurality of output values of a second well of the number of wells as tested from the test separator for a second predetermined measurement period, the plurality of output values tested while the second well is solitarily coupled to the test separator, and the plurality of output values of the second well recorded and analyzed via the computing system;

a plurality of measurements taken from the commingle separator of a subset of the number of wells, the subset including the first well and not including the second well, the measurements relating to data associated with the subset of the number of wells; and an interpolated value of the first well based on the first plurality of output values of the first well;

wherein the interpolated value of the first well is used against the measurements relating to data associated with the subset of the number of wells to determine a percentage of a total of the measurements relating to the first well; and wherein each well of the number of wells is rotated through the test separator for precise measuring of associated output values, the associated output values used to determine associated interpolated values for use with measurements taken via the commingle separator; and further comprising a second plurality of output values of the first well as measured via the test separator for a third predetermined measurement period, as the first well is solitarily coupled to the test separator for a second time, the second plurality of output values recorded and analyzed via the computing system;

wherein the second plurality of output values is used to update the interpolated value of the first well.

19. A system for well flowback monitoring, the system comprising:

a test separator;

a commingle separator;

a number of wells in selective fluid connection with both the test separator and the commingle separator, the number of wells is greater than one;

a computing system in data communication with the test separator and the commingle separator, the computing system, test separator, and commingle separator monitor the number of wells;

a plurality of output values of a first well of the number of wells as tested from the test separator for a predetermined measurement period, the plurality of output values tested while the first well is solitarily coupled to the test separator, and the plurality of output values of the first well recorded and analyzed via the computing system;

a plurality of output values of a second well of the number of wells as tested from the test separator for a second predetermined measurement period, the plurality of output values tested while the second well is solitarily coupled to the test separator, and the plurality of output values of the second well recorded and analyzed via the computing system;

a plurality of measurements taken from the commingle separator of a subset of the number of wells, the subset including the first well and not including the second well, the measurements relating to data associated with the subset of the number of wells; and an interpolated value of the first well based on the plurality of output values of the first well;

wherein the interpolated value of the first well is used against the measurements relating to data associated with the subset of the number of wells to determine a percentage of a total of the measurements relating to the first well;

wherein each well of the number of wells is rotated through the test separator for precise measuring of associated output values, the associated output values used to determine associated interpolated values for use with measurements taken via the commingle separator; and wherein the interpolated value is modified in response to one or more operating conditions.

20. The system of claim 19, wherein the one or more operating conditions are determined through machine learning analysis of the computing system.

21. The system of claim 19, wherein the one or more operating conditions are user input.

22. A system for well flowback monitoring, the system comprising:

a test separator;

a commingle separator;

a number of wells in selective fluid connection with both the test separator and the commingle separator, the number of wells is greater than one;

a computing system in data communication with the test separator and the commingle separator, the computing system, test separator, and commingle separator monitor the number of wells;

a plurality of output values of a first well of the number of wells as tested from the test separator for a predetermined measurement period, the plurality of output values tested while the first well is solitarily coupled to the test separator, and the plurality of output values of the first well recorded and analyzed via the computing system;

a plurality of output values of a second well of the number of wells as tested from the test separator for a second predetermined measurement period, the plurality of output values tested while the second well is solitarily coupled to the test separator, and the plurality of output values of the second well recorded and analyzed via the computing system;

a plurality of measurements taken from the commingle separator of a subset of the number of wells, the subset including the first well and not including the second well, the measurements relating to data associated with the subset of the number of wells; and an interpolated value of the first well based on the plurality of output values of the first well;

wherein the interpolated value of the first well is used against the measurements relating to data associated with the subset of the number of wells to determine a percentage of a total of the measurements relating to the first well;

wherein each well of the number of wells is rotated through the test separator for precise measuring of associated output values, the associated output values used to determine associated interpolated values for use with measurements taken via the commingle separator; and wherein the computing system is at least partially housed within one of the test separator and the commingle separator.

* * * * *